US010172446B2

(12) United States Patent
Nakamura et al.

(10) Patent No.: US 10,172,446 B2
(45) Date of Patent: Jan. 8, 2019

(54) BRISTLE FOR ANTIBACTERIAL COSMETIC BRUSH, AND ANTIBACTERIAL COSMETIC BRUSH OBTAINED USING SAID BRISTLE AND PROCESS FOR PRODUCING SAME

(71) Applicants: Kenji Nakamura, Osaka (JP); Koji Nakamura, Osaka (JP)

(72) Inventors: Kenji Nakamura, Osaka (JP); Koji Nakamura, Osaka (JP)

(73) Assignees: Kenji Nakamura, Osaka (JP); Koji Nakamura, Osaka (JP)

( * ) Notice: Subject to any disclaimer, the term of this patent is extended or adjusted under 35 U.S.C. 154(b) by 833 days.

(21) Appl. No.: 14/431,717

(22) PCT Filed: Oct. 4, 2013

(86) PCT No.: PCT/JP2013/077061
§ 371 (c)(1),
(2) Date: Mar. 26, 2015

(87) PCT Pub. No.: WO2014/054777
PCT Pub. Date: Apr. 10, 2014

(65) Prior Publication Data

US 2015/0257524 A1 Sep. 17, 2015

(30) Foreign Application Priority Data

Oct. 4, 2012 (JP) ..... 2012-221771
Oct. 3, 2013 (JP) ..... 2013-207866

(51) Int. Cl.
*A46D 1/04* (2006.01)
*A46D 1/00* (2006.01)
(Continued)

(52) U.S. Cl.
CPC ..... *A46D 1/006* (2013.01); *A46D 1/0207* (2013.01); *A46D 1/04* (2013.01); *D01F 1/103* (2013.01);
(Continued)

(58) Field of Classification Search
CPC ..... A46D 1/04; A46D 1/0261; A46D 1/0207
See application file for complete search history.

(56) References Cited

U.S. PATENT DOCUMENTS 8,178,603 B2 * 5/2012 Eckel ..... C08L 69/00 524/127
8,178,608 B2 * 5/2012 Nakamura ..... C08L 69/00 106/469
(Continued)

FOREIGN PATENT DOCUMENTS

EP 2695542 A1 2/2014
JP 2006002256 A 1/2006
(Continued)

OTHER PUBLICATIONS

Notification of Transmittal of Translation of the International Preliminary Report on Patentability (PCT/IB/338) dated Apr. 16, 2014, with International Preliminary Report on Patentability (PCT/IB/373) and Written Opinion of the International Searching Authority (PCT/ISA/237), for corresponding international application PCT/JP2013/077061.
(Continued)

*Primary Examiner* — Michael Jennings
(74) *Attorney, Agent, or Firm* — Law Office of Katsuhiro Arai

(57) ABSTRACT

An antibacterial cosmetic brush bristle material made of a polyester resin filament that has irregularities formed on its surface and comprises 70.0 to 90.0 percent by weight of polytrimethylene terephthalate, 29.2 to 9.9 percent by
(Continued)

weight of polybutylene terephthalate, and 0.8 to 0.1 percent by weight of inorganic particles constituting silver-containing soluble glass; a cosmetic brush using such bristle material; and a method of manufacturing such brush.

8 Claims, 3 Drawing Sheets

(51) Int. Cl.
*D01F 1/10* (2006.01)
*D01F 6/92* (2006.01)

(52) U.S. Cl.
CPC ..... *D01F 6/92* (2013.01); *A46B 2200/10* (2013.01); *A46B 2200/1013* (2013.01); *Y10T 428/2976* (2015.01)

(56) References Cited

U.S. PATENT DOCUMENTS

| | | | | |
|---|---|---|---|---|
| 8,748,510 | B2 * | 6/2014 | Inagaki | C09K 21/14 523/201 |
| 9,085,835 | B2 * | 7/2015 | Tang | D06N 3/0006 |
| 9,644,091 | B2 * | 5/2017 | Mizukami | C08L 23/0853 |
| 2004/0202703 | A1 | 10/2004 | Meyer-Ingold et al. | |
| 2006/0062831 | A1 | 3/2006 | Meyer-Ingold et al. | |
| 2006/0088711 | A1 * | 4/2006 | Nakamura | A46D 1/00 428/364 |
| 2009/0215934 | A1 * | 8/2009 | Nakamura | C08K 9/08 524/115 |
| 2012/0329910 | A1 * | 12/2012 | Lee | C08L 67/02 523/436 |
| 2013/0065034 | A1 * | 3/2013 | Muramatsu | H01B 13/321 428/213 |
| 2014/0020197 | A1 | 1/2014 | Nakamura et al. | |

FOREIGN PATENT DOCUMENTS

| | | | |
|---|---|---|---|
| JP | 2006141991 | A | 6/2006 |
| JP | 2006257189 | A | 9/2006 |
| JP | 2006524520 | A | 11/2006 |
| JP | 2008109990 | A | 5/2008 |
| JP | 2009142481 | A | 7/2009 |
| WO | 0138615 | A1 | 5/2001 |
| WO | 2008060005 | A1 | 5/2008 |
| WO | 2012137328 | A1 | 10/2012 |

OTHER PUBLICATIONS

Extended European Search Report (EESR) dated Apr. 25, 2016, issued for corresponding European patent application No. EP13844501.
International Search Report (ISR) dated Nov. 5, 2013, issued for International application No. PCT/JP2013/077061.

* cited by examiner

[Fig. 1]
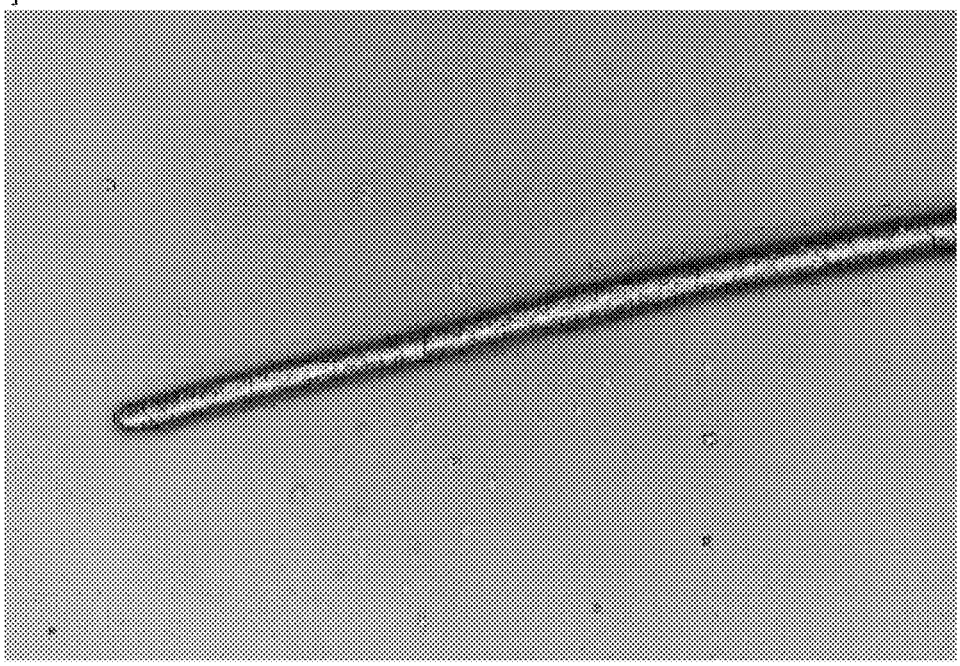
[Fig. 2]
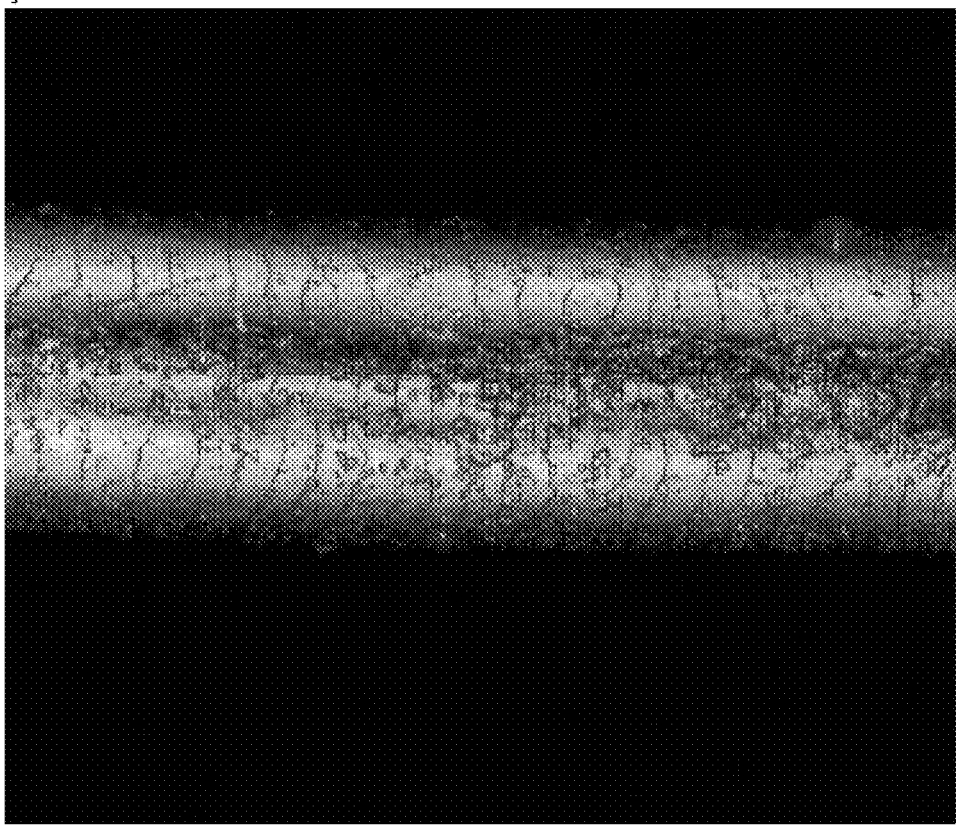

[Fig. 3]
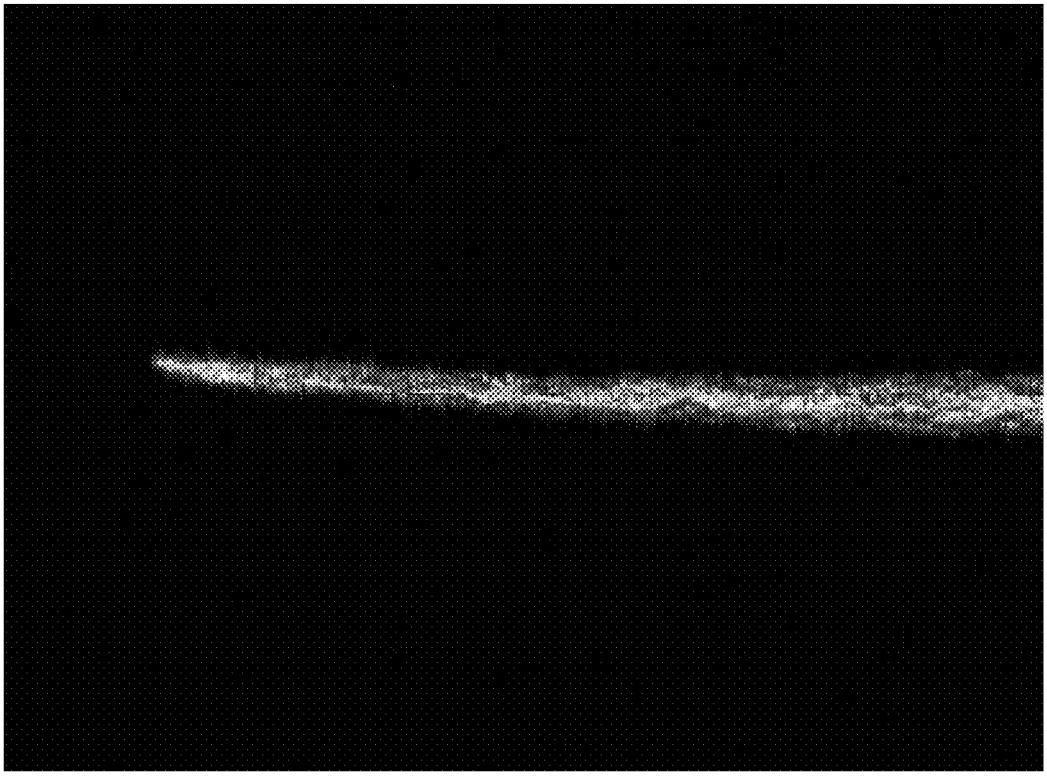
[Fig. 4]
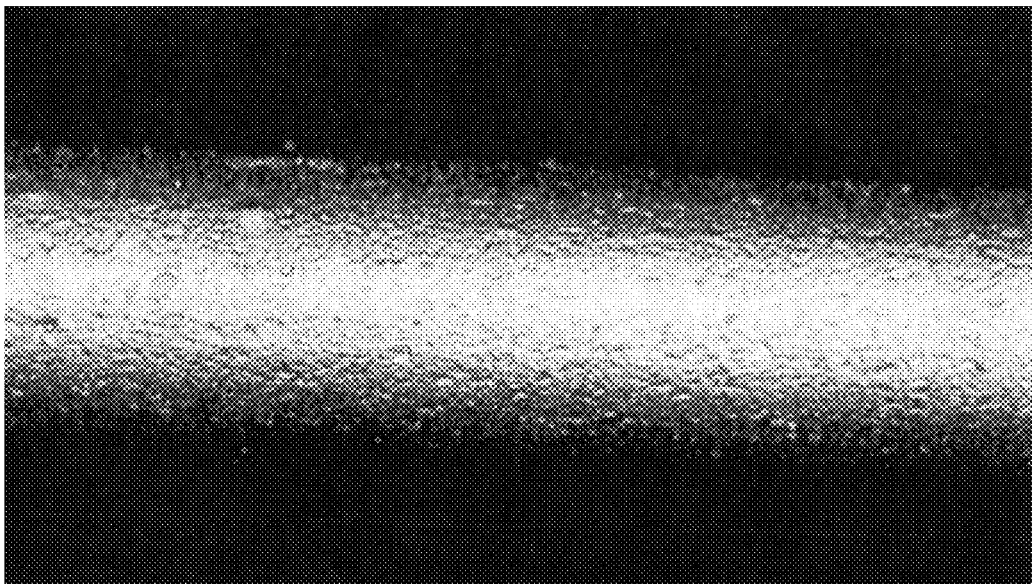

[Fig. 5]
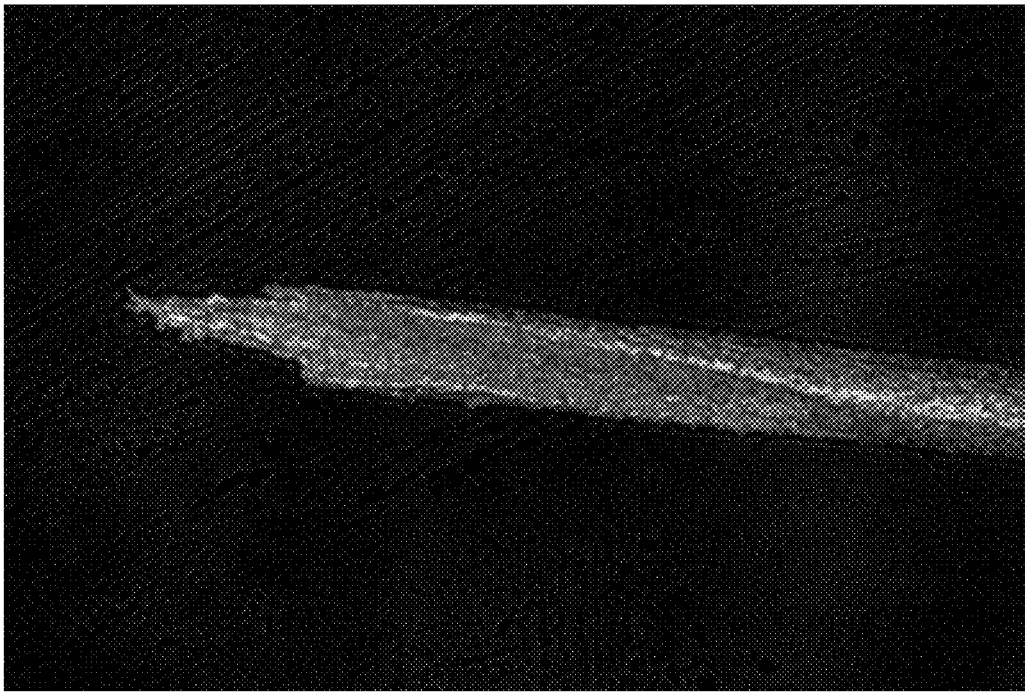
[Fig. 6]
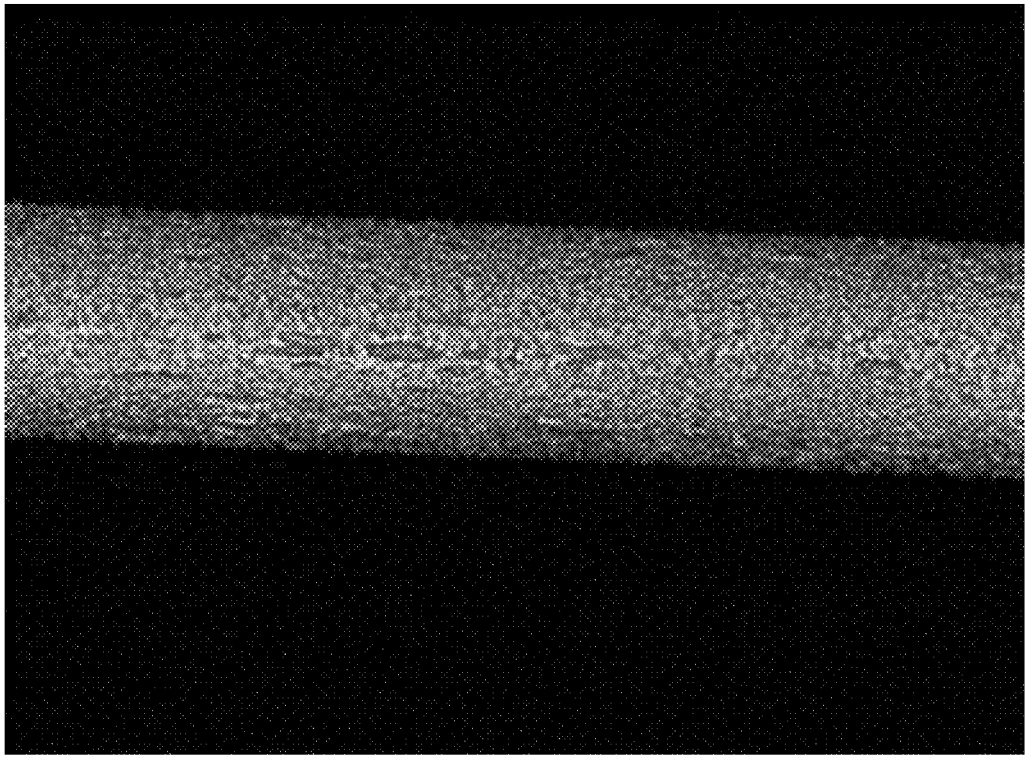

BRISTLE FOR ANTIBACTERIAL COSMETIC BRUSH, AND ANTIBACTERIAL COSMETIC BRUSH OBTAINED USING SAID BRISTLE AND PROCESS FOR PRODUCING SAME

This application is the U.S. National Phase under 35 U.S.C. § 371 of International Application PCT/JP2013/077061, filed Oct. 4, 2013, which claims priorities to Japanese Patent Applications No. 2012-221771, filed Oct. 4, 2012 and No. 2013-207866, filed Oct. 3, 2013. The International Application was published under PCT Article 21(2) in a language other than English.

TECHNICAL FIELD

The present invention relates to an antibacterial cosmetic brush bristle material using polyester resin filaments, an antibacterial cosmetic brush using such bristle material, and a method of manufacturing such brush, and more specifically to: an antibacterial cosmetic brush bristle material made with alkali-treated rough surface filaments constituted by a resin composition comprising polyester resin polytrimethylene terephthalate (hereinafter referred to as "PTT") and polybutylene terephthalate (hereinafter referred to as "PBT") and further containing silver-containing soluble glass; an antibacterial cosmetic brush using such bristle material that offers excellent feel during use as well as excellent loading property (picking-up property plus retention property) and transfer property with respect to cosmetic material; and a method of manufacturing such brush.

BACKGROUND ART

Traditionally squirrel bristles, horse bristles, goat bristles, and other animal bristles are used as bristle materials for cosmetic brushes, and reportedly these animal bristles feel comfortable on the skin, or in other words offer good feel during use, and also provide good loading property and transfer property. Cosmetic brushes made of squirrel bristles are highly received by consumers as highest quality cosmetic brushes. Despite having the aforementioned advantages, however, animal bristles are natural resources and have some drawbacks such as limited supply, and accordingly cosmetic brush bristle materials made of synthetic fibers are proposed in recent years as alternatives to animal bristles.

For example, Patent Literature 1 proposes a cosmetic brush bristle material having recesses on its surface. The proposed cosmetic brush bristle material is made by mixing together 100 parts by weight of PBT and 5 to 15 parts by weight of silica, talc, silver zeolite or other inorganic powder with an average particle size of 0.5 to 1.0 μm, and then melting and spinning the mixture, with the obtained filament stretched by five to six times to cause the aforementioned inorganic powder to be embedded at the surface and form recesses. Filaments thus obtained are then bundled and cut to a specified length, after which one end of the obtained fiber bundle is soaked in alkali solution to enlarge the aforementioned recesses, while the one end is melted and reduced in weight and tapered. It is disclosed that the cosmetic brush bristle material using the aforementioned filament having recesses provides loading property and transfer property equivalent to those of animal bristles because the enlarged recesses created on the filament surface by means of alkali treatment act the same way as cuticles on animal bristles (refer to Patent Literature 1).

Patent Literature 2 proposes a brush bristle material made of PTT having irregularities on its surface. Hydrolyzing this PTT brush bristle material by soaking it in alkali treatment solution requires at least three times longer than the normal hydrolysis time of the PBT brush bristle material, and this resistance to hydrolysis reduces the tapering productivity and adds to cost. For this reason, the aforementioned brush bristle material has a tapered tip at the end, which is achieved by melting and spinning PTT and stretching the obtained filament by five to six times and then soaking approx. 10 to 20 mm on one longitudinal end of the bundle of such filaments in alkali treatment solution containing amine catalyst to treat the filaments for 1 to 2 hours at 110 to 130° C., thereby forming tapered tips at the ends of the aforementioned filaments by means of alkali treatment and also forming irregularities of 1 to 20 μm on their surface.

Additionally, the PTT filaments in Examples 1 and 2 of the cosmetic brush bristle material proposed in Patent Literature 2 have a fineness of 80 dtex and 100 dtex, respectively. It is disclosed that, by using a treatment solution constituted by sodium hydroxide, hydrolysis-promoting catalyst, penetrating agent, or oligomer solvent as the aforementioned alkali treatment solution, a brush bristle material having fine irregularities of 1 to 20 μm at intervals of 5 to 50 μm on the surface of the tapered tip can be obtained, and if the alkali treatment is followed by post-treatment using heated aqueous solution of benzyl ammonium chloride compound or naphthoquinone compound, antibacterial property can be added (refer to Patent Literature 2).

BACKGROUND ART LITERATURE

Patent Literature

[Patent Literature 1] Japanese Patent Laid-open No. 2008-109990

[Patent Literature 2] Japanese Patent Laid-open No. 2006-141991

SUMMARY OF THE INVENTION

Problems to be Solved by the Invention

The cosmetic brush bristle materials made of a polyester resin filament in Patent Literatures 1 and 2 have a tapered tip on one end of the filament formed by alkali treatment. With the PBT filament in Patent Literature 1, where PBT is mixed with 5 to 15 parts by weight of inorganic powder and the mixture is stretched by five to six times, the drawing speed, temperature, etc., must be strictly managed in the drawing process; otherwise, the filament may break. Also, because recesses are formed on the filament surface as a result of alkali treatment, the brush bristle material may break in areas along the tapered tip that are sandwiched by two facing recesses.

On the other hand, the PTT filament cosmetic brush bristle material in Patent Literature 2 has a fineness of 80 dtex (88.52 μm (calculated at a specific gravity of 1.30)) or 100 dtex (98.97 μm (calculated at a specific gravity of 1.30)). A filament of each thickness is soaked at high temperature in alkali treatment solution containing amine catalyst and treated for 1 to 2 hours, to provide irregularities of 1 to 20 μm at intervals of approx. 5 to 50 μm on the filament surface, after which heated aqueous solution of benzyl ammonium chloride compound, etc., is used to apply antibacterial treatment. For this reason, while the aforementioned cosmetic brush bristle material is already made into products that offer the same feel during use as squirrel bristles and are regarded as highest in quality, it takes time to form and treat the tapered tip and apply antibacterial treatment subsequently and this leads to lower productivity compared to PBT-filament counterparts and a need to prepare various treatment solutions, thus giving rise to a problem that these brush materials cannot be manufactured at low cost. There is also a problem that producing thin brush bristle materials of approx. 45 to 65 μm just like squirrel bristles is difficult because they would break in areas along the tapered tip that are sandwiched by two facing recesses.

Accordingly, one object of the present invention, which was made in light of the actual situations mentioned above, is to allow for manufacturing of an antibacterial cosmetic brush bristle material using alkali treatment solution free of amine catalyst and without a need for subsequent antibacterial treatment using heated aqueous solution of benzyl ammonium chloride compound, etc. Another object of the present invention is to provide an antibacterial cosmetic brush bristle material which uses a polyester resin filament whose tapered tip has irregularities on its surface and which does not break in areas along the tapered tip. Yet another object of the present invention is to provide an antibacterial cosmetic brush using such bristle material, which can be manufactured at low cost, has a feel during use just like a cosmetic brush using squirrel or other animal bristles, and offers good loading property and transfer property with respect to powder or other cosmetic materials.

Means for Solving the Problems

The inventors of the present invention discovered, after repeated studies in earnest to achieve the aforementioned objects, that by soaking in alkali treatment solution a cosmetic filament made of a resin composition comprising polyester resins PTT and PBT and further containing soluble glass that in turn contains water-soluble silver, many irregularities could be formed over the entire surface of the tapered tip, the filament would not break in areas along the tapered tip, and its modulus of stretch (%) and Young's modulus ($N/mm^2$) would change according to the blending ratio of PTT and PBT, and completed the cosmetic brush bristle material under the present invention accordingly. The inventors further discovered that an antibacterial cosmetic brush using such bristle material would offer good feel during use just like a cosmetic brush using squirrel or other animal bristles, as well as good loading property and transfer property with respect to powder or other cosmetic materials. Then, they completed the present invention consisting of an antibacterial cosmetic brush bristle material, an antibacterial cosmetic brush using such bristle material, and a method of manufacturing such brush.

In other words, the present invention is described as follows.

The antibacterial cosmetic brush bristle material of the invention pertaining to Embodiment 1 is an antibacterial cosmetic brush bristle material made of a polyester resin filament containing inorganic particles and having a tapered tip, characterized in that the polyester resin filament is a resin composition comprising 70.0 to 90.0 percent by weight of polytrimethylene terephthalate and 29.2 to 9.9 percent by weight of polybutylene terephthalate, the inorganic particles constitute 0.8 to 0.1 percent by weight of soluble glass that contains silver, and the tapered tip has irregularities over its entire surface.

The antibacterial cosmetic brush bristle material of the invention pertaining to Embodiment 2 is characterized in that the concentration of silver in the silver-containing soluble glass is in a range of 1.0 to 4.0 percent by weight.

The antibacterial cosmetic brush bristle material of the invention pertaining to Embodiment 3 is characterized in that the thickness of the filament is 50 to 150 μm.

The antibacterial cosmetic brush bristle material of the invention pertaining to Embodiment 4 is characterized in that the antibacterial cosmetic brush bristle material has a bacteriostatic activity value in a range of 2.2 to 6 (JIS L 1902-1998 (ISO 20743)).

The antibacterial cosmetic brush bristle material of the invention pertaining to Embodiment 5 is characterized in that a part where silver-containing soluble glass is exposed in the shape of projection is formed on the body of the bristle material continuing to the tapered tip.

The antibacterial cosmetic brush bristle material of the invention pertaining to Embodiment 6 is characterized in that the antibacterial cosmetic brush bristle material has a straight or curled shape.

The antibacterial cosmetic brush of the invention pertaining to Embodiment 7 is characterized in that it uses the antibacterial cosmetic brush bristle material of Embodiment 1.

The antibacterial cosmetic brush of the invention pertaining to Embodiment 8 is characterized in that it is a brush for liquids, a lip brush, or nail care brush.

The method of manufacturing an antibacterial cosmetic brush of the invention pertaining to Embodiment 9 is a method of manufacturing antibacterial cosmetic brush bristle material made of a polyester resin filament containing inorganic particles and having a tapered tip, wherein the polyester resin filament is a resin composition comprising 70.0 to 90.0 percent by weight of polytrimethylene terephthalate and 29.2 to 9.9 percent by weight of polybutylene terephthalate, the inorganic particles constitute 0.8 to 0.1 percent by weight of soluble glass that contains silver, and the tapered tip has irregularities over its entire surface, characterized by comprising: a step to melt, knead, and extrude a resin composition using a spinning machine and stretch the extruded resin by four to five times at the spinning mouth by means of stretching under heat to manufacture a filament; a step to bundle filaments thus manufactured and cut them to a specified length; a step to alkali-treat the cut end of the bundle using aqueous solution of sodium hydroxide to form a tapered tip at the end, while forming irregularities on the surface of the tip at the same time; a step to wash the bundle in water and dry it; and a step to embed the brush bristle materials in a bristle bundle retention member.

Effects of the Invention

With the antibacterial cosmetic brush bristle material proposed by the present invention, polyester resins PTT and PBT are mixed by 70.0 to 90.0 percent by weight and 29.2 to 9.9 percent by weight, respectively, and then silver-containing soluble glass whose heat conductivity is approx. five times as high as these resins is added by 0.8 to 0.1 percent by weight, to form irregularities of 1 to 2 μm over the entire surface of the alkali-treated tapered tip by means of the dissolutive promoting action of silver-containing soluble glass. This way, the manufacturing cost can be kept low because no amine catalyst or heated aqueous solution of benzyl ammonium chloride compound, etc., is used and any traditionally known alkali treatment solution is all that is needed. In addition, by blending the PTT and PBT with silver-containing soluble glass in the manner mentioned above, the aforementioned antibacterial cosmetic brush bristle material can be manufactured with a thinness of approx. 45 to 65 μm just like squirrel bristles, and without breaking in areas along the tapered tip.

Also, the antibacterial cosmetic brush proposed by the present invention has irregularities of 1 to 2 μm formed over the entire surface of each tapered tip in a manner similar to the surface shape of an animal bristle, and therefore provides good loading property and transfer property with respect to powder and other cosmetic materials. In addition, the antibacterial cosmetic brush manufactured using bristle materials of approx. 45 to 65 μm in thickness just like squirrel bristles has excellent feel during use similar to brush bristle materials using squirrel bristles. Moreover, while plate brushes traditionally used for theater makeup require elasticity and thus use thick bristles of approx. 150 μm, the antibacterial cosmetic brush proposed by the present invention can be manufactured as a plate brush with approx. 150-μm-thick elastic bristles by blending PBT by 25 percent by weight or more.

Furthermore, by changing the blending ratio of PTT and PBT constituting its antibacterial cosmetic brush bristle material, the antibacterial cosmetic brush proposed by the present invention can be manufactured as various types of cosmetic brushes, such as a brush for liquids, a lip brush, nail care brush, foundation brush, powder brush, shadow brush, cheek brush, highlight brush, and concealer brush, according to the area of the face where the brush is used and the state of the cosmetic material.

Also, the antibacterial cosmetic brush proposed by the present invention offers excellent antibacterial effect as it has silver-containing soluble glass on the surface of its tapered tips as mentioned above. Lip brushes used to apply lip-gloss to the lips, for example, are said to generate foul smell by allowing bacteria to grow in the brush case as the food and other contaminants attached to the lips are transferred onto the brush bristle materials and enter the case; under the present invention, however, silver ions suppress bacterial growth and achieve excellent deodorizing effect.

BRIEF DESCRIPTION OF THE DRAWINGS

FIG. 1 Laser microgram taken at ×1000 magnifications, capturing the surface of the tip of a squirrel bristle.

FIG. 2 Laser microgram taken at ×1000 magnifications, capturing the surface of the body of a squirrel bristle.

FIG. 3 Laser microgram taken at ×1000 magnifications, capturing the surface of the tip of the filament in Example 5.

FIG. 4 Laser microgram taken at ×1000 magnifications, capturing the surface of the body of the filament in Example 5.

FIG. 5 Laser microgram taken at ×1000 magnifications, capturing the surface of the tip of the filament in Comparative Example 2.

FIG. 6 Laser microgram taken at ×1000 magnifications, capturing the surface of the body of the filament in Comparative Example 2.

MODE FOR CARRYING OUT THE INVENTION (Thermoplastic Resin)

For the polyester resin used for the cosmetic brush bristle material, a resin composition constituted by a mixture of PTT and PBT is used from the viewpoints of physical properties including flexibility, elastic recoverability, and water resistance. As mentioned above, a PTT cosmetic brush bristle material requires at least three times longer to hydrolyze by soaking it in alkali treatment solution compared to a PBT cosmetic brush bristle material, and therefore PBT, which is easier to hydrolyze in alkali treatment solution, is blended to make a filament. In the meantime, it is said that PTT filaments, although having both the form stability of polyester and softness of nylon, are not suitable, because of their very softness, for use as cosmetic brush bristle materials that require hardness. In addition, various types of cosmetic brushes are commercially available which use PBT filaments that are easy to dye, offer excellent elasticity when made into a processed yarn, and are harder than PTT filaments. Accordingly, a filament is produced by blending PBT with PTT to compensate for the softness of a PTT filament.

PTT and PBT are blended at a percent-by-weight ratio of 70.0 to 90.0:29.2 to 9.9 when the total filament composition accounts for 100 percent by weight.

(Silver-Containing Soluble Glass)

Silver-containing soluble glass is soluble in water. When the total filament composition accounts for 100 percent by weight, preferably silver-containing soluble glass is blended by 0.8 to 0.1 percent by weight. In addition, preferably the concentration of silver in silver-containing soluble glass is in a range of 1.0 to 4.0 percent by weight.

Three types of silver-containing soluble glass are sold in Japan, each having an average particle size of 1 to 10 μm and silver concentration of 1.4, 2.0 or 3.0 percent by weight, respectively. Such silver-containing soluble glass is generally called "silver glass" and this designation is used in the tables below.

It is not desirable to blend silver-containing soluble glass of 1.4 percent by weight in silver concentration by less than 0.1 percent by weight, because hydrolysis is not promoted. When the blending ratio exceeds 0.8 percent by weight, on the other hand, the filament would break during the hydrolysis process, and accordingly, silver-containing soluble glass is desirably blended into the aforementioned resin by a blending ratio in a range of 0.1 to 0.8 percent by weight. In addition, glass with an average particle size of 1 μm is desired in order to prevent the filament from breaking during the hydrolysis process.

The heat conductivity of silver-containing soluble glass varies around 1.40 W/m·K according to the material it is blended into. The silver-containing soluble glass used in the Examples has a heat conductivity of 1.40 W/m·K.

(Method of Manufacturing Antibacterial Cosmetic Brush Bristle Material)

Next, the method of manufacturing antibacterial cosmetic brush bristle material proposed by the present invention is explained.

As for the filament for antibacterial cosmetic brush bristle material, a mixture of PTT pellets, PBT pellets and silver-containing soluble glass powder, or mixture of PTT pellets and PBT pellets containing silver-containing soluble glass (or PBT pellets and PTT pellets containing silver-containing soluble glass), or mixture of PTT powder, PBT powder and silver-containing soluble glass powder, is agitated in such a way that the ingredients are dispersed uniformly, after which the agitated mixture is introduced to the hopper of a spinning machine and melted, kneaded, and extruded, and then spun from the spinning mouth, and the resulting yarn is stretched in three steps by four to five times under heat to manufacture a filament of approx. 76 μm. Filaments manufactured as above are then bundled in a column shape and cut to a specified length. The cut end is alkali-treated using aqueous solution of sodium hydroxide. Thereafter, the bundle is washed in water and dried.

Alternatively, the filament is crimped according to the gear crimp method, etc., and filaments crimped this way are then bundled in a column shape and cut to a specified length. The cut end is alkali-treated using aqueous solution of sodium hydroxide. Thereafter, the bundle is washed in water and dried.

When one end of the filament is soaked in alkali treatment solution, the silver-containing soluble glass on the surface of the filament is dissolved by the alkali treatment solution and thus contacts the alkali treatment solution over larger surface area, and hydrolysis is promoted as a result. This action of silver-containing soluble glass to promote hydrolysis by dissolving is hereinafter referred to as the "dissolutive-promoting action." The area on the one end where irregularities appear and whose shape tapers toward the end point is called the "tapered tip," and as the aqueous solution of sodium hydroxide is siphoned by the capillary effect into the filaments bundled in a column shape, the resin film covering the silver-containing soluble glass is dissolved and removed by the hydrolysis of resin. The capillary effect and the dissolution action cause projections to appear on the surface of the filament body, and this area is called the "body." After being spun into a yarn, the silver-containing soluble glass has resin film formed on its surface, and silver glass soluble glass is present as scattered particles, on top of which resin film is formed, thereby forming scattered projections that result partly from shrinkage and other contracting actions of resin. A small amount of alkali agent siphoned by the capillary effect removes only the resin film and consequently the silver glass is exposed as projections on the surface of the body.

Accordingly, the antibacterial cosmetic brush bristle material proposed by the present invention has projections formed in the tapered tip area where irregularities are formed over the entire surface, and also in the body area. The end point of the tapered tip has a cone shape and the smaller the thickness of the basal end that forms the cone shape, the better it feels on the skin. This thickness is basically the same as the thickness of the filament body.

In addition, the antibacterial cosmetic brush proposed by the present invention is such that foundation or other cosmetic material is applied using its tapered tips having the area of irregularities which is formed by the dissolutive promoting action of silver-containing soluble glass.

(Shape of Antibacterial Cosmetic Brush Bristle Material)

An antibacterial cosmetic brush bristle material can have one of two shapes: straight and curled. Straight bristle materials are used for brushes for liquids, lip brushes, or nail care brushes, to apply cosmetic materials in liquid form. Curled bristle materials are used for foundation brushes, powder brushes, shadow brushes, cheek brushes, highlight brushes, or concealer brushes, to apply cosmetic materials in powder form. For the method to curl the bristle material, the gear crimp method is generally used from the viewpoint of workability.

(Method of Manufacturing Antibacterial Cosmetic Brush)

The method of manufacturing antibacterial cosmetic brush proposed by the present invention comprises resin blending, spinning, alkali treatment, and bristle material embedding steps.

The polyester resin blending step is where a resin composition comprising 70.0 to 90.0 percent by weight of polytrimethylene terephthalate and 29.2 to 9.9 percent by weight of polybutylene terephthalate is blended with 0.8 to 0.1 percent by weight of silver-containing soluble glass. The spinning step is where this blended resin is melted, kneaded, and extruded using a spinning machine and the resin is stretched by four to five times at the spinning mouth by means of stretching under heat, to manufacture a filament. The alkali treatment step is where filaments thus spun are bundled in a column shape and cut to a specified length, after which the cut end is alkali-treated using aqueous solution of sodium hydroxide and then washed in water and dried. This alkali treatment forms a tip that tapers toward the end point at the end of the filament, as well as irregularities on the surface of the tapered tip. Alternatively, the aforementioned filaments may be crimped at the time of bundling, with the crimped filaments bundled and cut to a specified length. The bristle material embedding step is where the brush bristle materials that have been alkali-treated as mentioned above are embedded into a bristle bundle retention member and thus formed into a cosmetic brush.

EXAMPLES

PTT pellets (SORONA J2240 Semi-Dull manufactured by DuPont), PBT pellets (TORAYCOM 1401X06 manufactured by Toray) and silver-containing soluble glass (PG721ST manufactured by Koa Glass) were mixed and agitated to a uniform state. Alternatively, PTT powder (SORONA J2240 Semi-Dull manufactured by DuPont), PBT powder (TORAYCOM 1401X06 manufactured by Toray) and silver-containing soluble glass (PG721ST manufactured by Koa Glass) were mixed and dispersed uniformly.

The uniformly mixed resin was introduced to the hopper of a spinning machine and melted at 270° C., kneaded at 250° C., and extruded, and then spun at the spinning mouth and stretched in three stages by four to five times by means of stretching under heat, to manufacture a filament of approx. 76 μm. On the surface of this filament, silver glass particles were present as scattered projections, with thin resin film formed on their surface.

Filaments thus manufactured were bundled in the shape of a 5 cm diameter column, and cut to a length of 6 cm.

One end of the filament bundle was soaked at 120° C. in aqueous solution of sodium hydroxide of 12 percent by weight in concentration, and the filament bundle was soaked for up to 120 minutes while gradually raising the soaked part over time. The soak time was adjusted so that the end point of the tapered tip of the filament bundle would become 5 to 10 μm thick after hydrolysis.

The filaments above the soaked part in the filament bundle siphoned the aqueous solution of sodium hydroxide by the capillary effect and as a result, the resin covering the projections of silver-containing soluble glass on the filament surface was dissolved and removed to form a body having interspersed projections. The width of this body was freely adjustable by adjusting the filament bundling tension. Next, the bundle was washed in water and dried to obtain antibacterial cosmetic brush bristle materials.

If the silver-containing soluble glass is blended in a non-uniform manner when the filament of approx. 76 μm is alkali-treated to form a tapered tip, the tapered tip may break at this part where the glass is blended non-uniformly, and therefore it is essential that the PTT powder, PBT powder, and silver-containing soluble glass powder be mixed and agitated uniformly before being introduced to the hopper of the spinning machine. The three ingredients may be mixed and agitated, or two ingredients may be mixed first and the remaining ingredient added and mixed.

Examples 1 to 9

The antibacterial cosmetic brush bristle materials in Examples 1 to 9 below, each containing silver-containing soluble glass by one of three ratios, were manufactured according to the aforementioned melting/spinning manufacturing method.

Table 1 provides the specifics. Examples 1 to 3 had silver-containing soluble glass blended by 0.1 percent by weight, Examples 4 to 6 had silver-containing soluble glass blended by 0.5 percent by weight, and Examples 7 to 9 had silver-containing soluble glass blended by 0.8 percent by weight. The three types of filaments blended with silver-containing soluble glass manufactured according to the aforementioned method were stretched by four to five times under the aforementioned conditions, to manufacture filaments of approx. 76 μm in thickness. These filaments were given the aforementioned alkali treatment to form a tapered tip.

TABLE 1

| | Example 1 | Example 2 | Example 3 | Example 4 | Example 5 | Example 6 | Example 7 | Example 8 | Example 9 |
|---|---|---|---|---|---|---|---|---|---|
| PTT (wt %) | 70.0 | 80.0 | 90.0 | 70.0 | 80.0 | 90.0 | 70.0 | 80.0 | 90.0 |
| PBT (wt %) | 29.9 | 19.9 | 9.9 | 29.5 | 19.5 | 9.5 | 29.2 | 19.2 | 9.2 |
| Silver glass (wt %) | 0.1 | 0.1 | 0.1 | 0.5 | 0.5 | 0.5 | 0.8 | 0.8 | 0.8 |

Comparative Examples 1 to 4

In Comparative Example 1, a filament made of 100 percent PTT by weight was given the aforementioned alkali treatment. In Comparative Example 2, 99 percent by weight of PTT was blended with 1 percent by weight of silver-containing soluble glass. In Comparative Example 3, a filament made of 100 percent PBT by weight was given the aforementioned alkali treatment. In Comparative Example 4, 99 percent by weight of PBT was blended with 1 percent by weight of silver-containing soluble glass.

These filaments were given the aforementioned alkali treatment to form a body and a tapered tip.

The PTT and PBT in the Comparative Examples were the same as the resins used in the Examples, while the silver-containing soluble glass in the Comparative Examples was also the same as the one used in the Examples.

TABLE 2

| | Comparative Example 1 | Comparative Example 2 | Comparative Example 3 | Comparative Example 4 |
|---|---|---|---|---|
| PTT (wt %) | 100.0 | 99.0 | — | — |
| PBT (wt %) | — | — | 100 | 99.0 |
| Silver glass (wt %) | — | 1 | — | 1 |

FIG. 3 is a laser microgram taken at ×1000 magnifications, capturing the surface of the tip of the filament in Example 5. The end point of the tip is 5 μm thick and numerous irregularities are formed on its surface.

FIG. 4 is a laser microgram taken at ×1000 magnifications, capturing the surface of the body of the filament in Example 5. The body is 45 μm thick and many irregularities are formed on its surface.

FIG. 5 is a laser microgram taken at ×1000 magnifications, capturing the surface of the tip of the filament in Comparative Example 2. The end point of the tip is 53 μm thick and the tip is broken in the middle.

FIG. 6 is a laser microgram taken at ×1000 magnifications, capturing the surface of the body of the filament in Comparative Example 2. The body is 45 μm thick and many irregularities are formed on its surface.

The surfaces of the tapered tips of the antibacterial cosmetic brush bristle materials in Examples 1 to 9 were then captured with a laser microscope (VK-8710 VK-Analyzer (manufactured by Keyence)) to measure the height and distribution of irregularities on their surfaces and thickness of the end point of the tapered tips. The measured heights, distributions, and thicknesses are shown in Table 3.

TABLE 3

| | Example 1 | Example 2 | Example 3 | Example 4 | Example 5 | Example 6 | Example 7 | Example 8 | Example 9 |
|---|---|---|---|---|---|---|---|---|---|
| Silver glass content (wt %) | 0.1 | 0.1 | 0.1 | 0.5 | 0.5 | 0.5 | 0.8 | 0.8 | 0.8 |
| Height of irregularities (μm) | 1.0 | 1.1 | 1.1 | 1.2 | 1.2 | 1.1 | 1.1 | 1.2 | 1.2 |
| Distribution of irregularities (quantity per $\mu m^2$) | 25 | 28 | 27 | 28 | 33 | 35 | 36 | 37 | 39 |
| Thickness of tip (μm) | 3 | 3 | 4 | 6 | 5 | 5 | 10 | 12 | 10 |
| Abnormal thickness (μm (%)) | — | — | — | — | — | — | — | — | — |
| Bacteriostatic activity value | 3.8 | 4.0 | 4.2 | 4.6 | 4.8 | 5.0 | 5.2 | 5.4 | 5.6 |

Next, the surface of a squirrel bristle, surface of the filament of one of the aforementioned antibacterial cosmetic brush bristle materials (Example 5), and surface of the filament in Comparative Example 2, were captured using a laser microscope (VK-8710 VK-Analyzer (manufactured by Keyence)) at ×1000 magnifications, the micrograms of which are shown in FIGS. 1 to 5.

FIG. 1 is a laser microgram taken at ×1000 magnifications, capturing the surface of the tip of a squirrel bristle. The end point of the tip is 7 μm thick and many irregularities are formed on its surface.

FIG. 2 is a laser microgram taken at ×1000 magnifications, capturing the surface of the body of a squirrel bristle. The body is 25 μm thick and many ring-shaped irregularities are formed on its surface.

The surfaces of the tapered tips of the bristle materials in Comparative Examples 1 to 4 were captured with a laser microscope (VK-8710 VK-Analyzer (manufactured by Keyence)) to measure the height and distribution of irregularities on their surfaces and thickness of the end point of the tapered tips. The measured heights, distributions, and thicknesses are shown in Table 4.

As shown in Table 4, Comparative Examples 2 and 4 had tips of 40 μm in thickness accounting for 30%. This thickness of tip is 10 times the normal thickness or more and thus abnormal. Since the filament is approx. 76 μm thick, it is abnormal for the tip formed by alkali treatment to have a thickness of 40 μm, and a cosmetic brush containing filaments of this thickness has a major defect as the bristles would irritate the skin.

This abnormal thickness occurs in the tapered tip area as a result of alkali treatment when the silver-containing soluble glass is contained by 1.0 percent by weight. Accordingly, it was understood that adding the silver-containing soluble glass to the PTT and PBT by 1.0 percent by weight would be difficult.

TABLE 4

| | Comparative Example 1 | Comparative Example 2 | Comparative Example 3 | Comparative Example 4 |
|---|---|---|---|---|
| Silver glass content (wt %) | — | 1.0 | — | 1.0 |
| Height of irregularities (μm) | 0.1 | 1.6 | 1.0 | 1.6 |
| Distribution of irregularities (quantity per $\mu m^2$) | 2 | 42 | 2 | 15 |
| Thickness of tip (μm) | 20 | 40 | 25 | 45 |
| Abnormal thickness (μm (%)) | — | 53 (30) | — | 50 (30) |
| Bacteriostatic activity value | 0.1 | 5.6 | 0.2 | 5.6 |

The bacteriostatic activity values in Tables 3 and 4 represent the values obtained by the antibacterial property test of *Staphylococcus aureus* based on the standards of JIS L 1902-1998 (ISO 20743).

The test results in Table 3 show measured values of *Staphylococcus aureus* bacteriostatic activity ranging from 3.8 to 5.6, indicating excellent antibacterial property. According to the aforementioned standards, a bacteriostatic activity value of 2.2 or more is considered to exceed the antibacterial/deodorizing standards, and the bacteriostatic activity values ranging from 3.8 to 5.6 are far greater than this level.

One problem of cosmetic brushes their users want resolved urgently is that as the brush contacts the skin, the resident bacteria on the skin and aquatic bacteria attach to the brush and grow, thus giving off an unpleasant smell. Once 99% of the bacteria are killed, foul smell becomes no longer detectable. Killing 99% of the bacteria translates to a bacteriostatic activity value of 2.2. Here, the antibacterial cosmetic brush bristle materials in Examples 1 to 9 indicate bacteriostatic activity values ranging from 3.8 to 5.6, indicating that the bacteria can be killed faster than when the bacteriostatic activity value is 2.2 so that they are quickly prevented from giving off a foul smell. The antibacterial cosmetic brush bristle materials in Examples 1 to 9 offer excellent antibacterial property and deodorizing property against resident bacteria on the skin and aquatic bacteria, because irregularities of silver-containing soluble glass are present at a distribution density of 25 to 39 recesses/projections per $\mu m^2$ over the entire surface of their tips.

The bacteriostatic activity values of Comparative Examples 1 and 3 in Table 4 are 0.1 and 0.2, respectively, because the PTT and PBT were not blended with silver-containing soluble glass. On the other hand, Comparative Examples 2 and 4 where the aforementioned silver-containing soluble glass was blended by 1.0 percent by weight offer excellent antibacterial effect as indicated by their high bacteriostatic value of 5.6; however, as mentioned above, some of the tips formed by alkali treatment had an abnormal thickness of 40 μm and a cosmetic brush containing bristles of this thickness has a major defect because they would irritate the skin.

(Use Test Results)

Powder brushes using the bristle materials in the Examples where silver-containing soluble glass was blended, and those in the Comparative Examples, were use-tested by five subjects and evaluated on a five-point scale of 1 to 5. The evaluation results of powder brushes are shown in Table 5 (Examples) and Table 6 (Comparative Examples).

In the five-point scale evaluation, "5" represents superior, "4" represents excellent, "3" represents average, "2" represents poor, and "1" represents very poor.

TABLE 5

| | Example 1 | Example 2 | Example 3 | Example 4 | Example 5 | Example 6 | Example 7 | Example 8 | Example 9 |
|---|---|---|---|---|---|---|---|---|---|
| Silver glass content (wt %) | 0.1 | 0.1 | 0.1 | 0.5 | 0.5 | 0.5 | 0.8 | 0.8 | 0.8 |
| Loading property | 3 | 3 | 3 | 4 | 4 | 4 | 4 | 4 | 4 |
| Transfer property | 3 | 3 | 3 | 4 | 4 | 4 | 4 | 4 | 4 |
| Feel during use | 3 | 3 | 4 | 3 | 3 | 3 | 3 | 3 | 3 |

TABLE 6

| | Comparative Example 1 | Comparative Example 2 | Comparative Example 3 | Comparative Example 4 | Squirrel bristle |
|---|---|---|---|---|---|
| Silver glass content (wt %) | — | 1.0 | — | 1.0 | — |
| Loading property | 2 | 3 | 2 | 3 | 5 |
| Transfer property | 2 | 4 | 2 | 3 | 5 |
| Feel during use | 4 | 2 | 2 | 2 | 5 |

Next, two property values, specifically modulus of stretch (%) and Young's modulus ($N/mm^2$), of Examples 1, 4, and 7, where PBT was blended by 29.9 to 29.2 percent by weight, Examples 2, 5, and 8, where PBT was blended by 19.9 to 19.2 percent by weight, and Examples 3, 6, and 9, where PBT was blended by 9.9 to 9.2 percent by weight, were measured and the results are shown in Tables 7 to 9.

TABLE 7

| PBT 29.9 to 29.2 percent by weight | Example 1 | Example 4 | Example 7 |
|---|---|---|---|
| Silver glass content (wt %) | 0.1 | 0.5 | 0.8 |
| Modulus of stretch (%) | 82 | 80 | 78 |
| Young's modulus ($N/mm^2$) | 3334 | 3384 | 3434 |

TABLE 8

| PBT 19.9 to 19.2 percent by weight | Example 2 | Example 5 | Example 8 |
|---|---|---|---|
| Silver glass content (wt %) | 0.1 | 0.5 | 0.8 |
| Modulus of stretch (%) | 87 | 85 | 83 |
| Young's modulus (N/mm$^2$) | 3233 | 3283 | 3333 |

TABLE 9

| PBT 9.9 to 9.2 percent by weight | Example 3 | Example 6 | Example 9 |
|---|---|---|---|
| Silver glass content (wt %) | 0.1 | 0.5 | 0.8 |
| Modulus of stretch (%) | 92 | 90 | 88 |
| Young's modulus (N/mm$^2$) | 3128 | 3178 | 3232 |

Table 10 shows the measured results of modulus of stretch (%) and Young's modulus (N/mm$^2$) of Comparative Examples 1 to 4.

TABLE 10

| | Comparative Example 1 | Comparative Example 2 | Comparative Example 3 | Comparative Example 4 |
|---|---|---|---|---|
| Silver glass content (wt %) | — | 1.0 | — | 0.1 |
| Modulus of stretch (%) | 94 | 92 | 40 | 38 |
| Young's modulus (N/mm$^2$) | 3067 | 3117 | 4047 | 4097 |

Examples 1, 4, and 7, where PBT was blended by 29.9 to 29.2 percent by weight had a modulus of stretch (%) of 78 to 82 and Young's modulus (N/mm$^2$) of 3334 to 3434, Examples 2, 5, and 8, where PBT was blended by 19.9 to 19.2 percent by weight had a modulus of stretch (%) of 83 to 87 and Young's modulus (N/mm$^2$) of 3233 to 3333, and Examples 3, 6, and 9, where PBT was blended by 9.9 to 9.2 percent by weight had a modulus of stretch (%) of 88 to 92 and Young's modulus (N/mm$^2$) of 3128 to 3232.

The above results show that the modulus of stretch increases as the PBT blending ratio decreases, while Young's modulus decreases as the PBT blending ratio decreases. In addition, while Comparative Example 1 (PTT 100 percent by weight) had a stretch modulus of 94 and Young's modulus of 3067 and Comparative Example 3 (PBT 100 percent by weight) had a stretch modulus of 40 and Young's modulus of 4047, the stretch modulus of Comparative Example 1 can be decreased from 94 to 78 and Young's modulus of Comparative Example 1 can be increased from 3067 to 3434 by blending PBT by 29.2 percent by weight.

The aforementioned relationships of PBT blending ratio, stretch modulus and Young's modulus suggest that any physical properties can be selected as desired according to the specific brush, such as a brush for liquids, lip brush, nail care brush, foundation brush, powder brush, shadow brush, cheek brush, highlight brush, or concealer brush.

Moreover, the brush bristle materials in Examples 1 to 9 offer better loading property and transfer property compared to Comparative Example 1 (PTT 100 percent by weight), because a tip that tapers toward the end point is formed on one end or both ends, and also because irregularities of 1 to 2 μm are provided over the entire surface of the tapered tip.

What is claimed is:

1. An antibacterial cosmetic brush bristle material made of a polyester resin filament containing inorganic particles and having a tapered tip, the antibacterial cosmetic brush bristle material characterized in that the polyester resin filament is a resin composition comprising 70.0 to 90.0 percent by weight of polytrimethylene terephthalate and 29.2 to 9.9 percent by weight of polybutylene terephthalate, the inorganic particles constitute 0.8 to 0.1 percent by weight of soluble glass that contains silver, and the tapered tip has irregularities over its entire surface, wherein a concentration of silver in the silver-containing soluble glass is in a range of 1.0 to 4.0 percent by weight, and the tapered tip of the polyester resin filament has a thickness of 3 to 12 μm.

2. The antibacterial cosmetic brush bristle material according to claim 1, characterized in that a thickness of the filament is 50 to 150 μm.

3. An antibacterial cosmetic brush bristle material according to claim 2, characterized in that the antibacterial cosmetic brush bristle material has a bacteriostatic activity value in a range of 2.2 to 6 (JIS L 1902-1998 (ISO 20743)).

4. An antibacterial cosmetic brush bristle material according to claim 3, characterized in that a part where silver-containing soluble glass is exposed in a shape of projections is formed on a body of the bristle material continuing to the tapered tip.

5. An antibacterial cosmetic brush bristle material according to claim 1, characterized in that the antibacterial cosmetic brush bristle material has a straight or curled shape.

6. The antibacterial cosmetic brush bristle material according to claim 5, characterized in that the antibacterial cosmetic brush bristle material has a straight or curled shape.

7. An antibacterial cosmetic brush using the antibacterial cosmetic brush bristle material in claim 1.

8. The antibacterial cosmetic brush according to claim 7, characterized in that it is a brush for liquids, lip brush, or nail care brush.

* * * * *